US006149414A

United States Patent [19]

Abelen et al.

[11] Patent Number: 6,149,414

[45] Date of Patent: Nov. 21, 2000

[54] OIL-SEALED VANE-TYPE ROTARY VACUUM PUMP WITH AN OIL PUMP

[75] Inventors: Thomas Abelen; Peter Muller, both of Cologne, Germany

[73] Assignee: Leybold Vakuum GmbH, Cologne, Germany

[21] Appl. No.: 08/983,539

[22] PCT Filed: Jul. 12, 1996

[86] PCT No.: PCT/EP96/03077

§ 371 Date: Jan. 14, 1998

§ 102(e) Date: Jan. 14, 1998

[87] PCT Pub. No.: WO97/04235

PCT Pub. Date: Feb. 6, 1997

[30] Foreign Application Priority Data

Jul. 19, 1995 [DE] Germany ..... 195 26 321

[51] Int. Cl.[7] ..... F01C 21/04

[52] U.S. Cl. ..... 418/88; 418/15; 418/63; 418/97; 418/102; 418/248

[58] Field of Search ..... 418/15, 63, 88, 418/97, 102, 248

[56] References Cited

U.S. PATENT DOCUMENTS

| | | | |
|---|---|---|---|
| 2,233,017 | 2/1941 | Lambin | 418/97 |
| 3,166,017 | 1/1965 | Mamo | 418/248 |
| 3,707,339 | 12/1972 | Budgen | 418/97 |
| 4,276,005 | 6/1981 | Bassan | 418/88 |
| 4,575,322 | 3/1986 | Paquet et al. | 418/97 |
| 4,967,707 | 11/1990 | Rogant | 418/248 |
| 5,181,414 | 1/1993 | Baret et al. | 73/40.7 |

FOREIGN PATENT DOCUMENTS

| | | |
|---|---|---|
| 0474066 | 8/1991 | European Pat. Off. . |
| 2609117 | 7/1988 | France . |
| 2401171 | 7/1975 | Germany . |
| 3518016 | 4/1986 | Germany . |
| 3730685 | 7/1988 | Germany . |
| 3922417 | 1/1991 | Germany . |
| 4325285 | 2/1995 | Germany . |

*Primary Examiner*—Thomas Denion
*Assistant Examiner*—Thai-Ba Trieu
*Attorney, Agent, or Firm*—Wall, Marjama Bilinski & Burr

[57] ABSTRACT

The invention concerns an oil-sealed vane-type rotary vacuum pump (1) with a rotor (3) and an oil pump (45, 46) whose suction chamber is fitted with feeds (64, 65) for gas and oil. In order to simplify the supply of a gas/oil mixture to the vacuum pump, the invention proposes that the gas and oil feeds (64, 65) are disposed in such a way that initially only oil and subsequently both oil and air are aspirated into the volume swept by the oil pump (45, 46) as it rotates.

8 Claims, 2 Drawing Sheets

OIL-SEALED VANE-TYPE ROTARY VACUUM PUMP WITH AN OIL PUMP

BACKGROUND OF THE INVENTION

Figure 1:
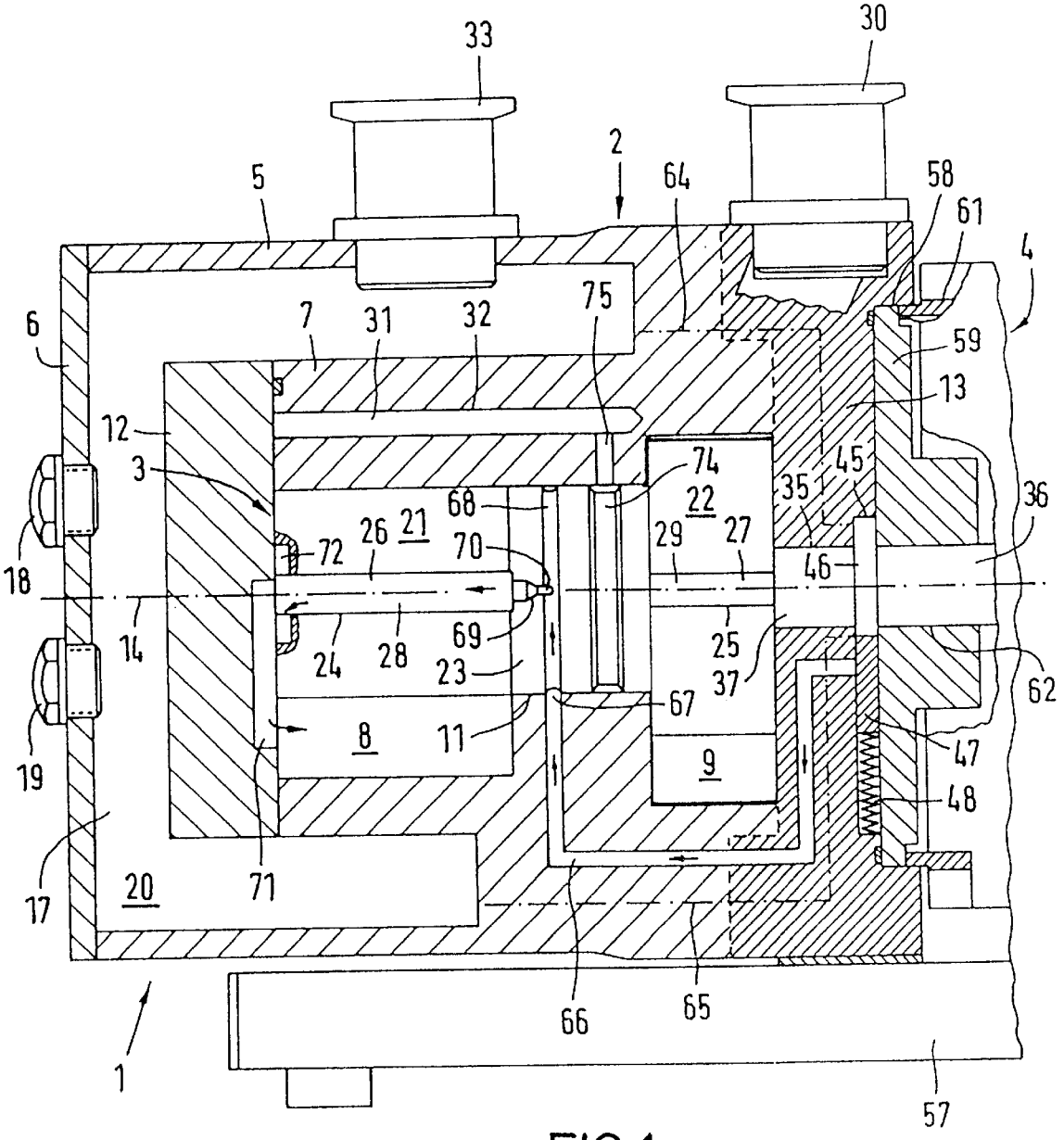

The invention concerns an oil-sealed vane-type rotary vacuum pump with an oil pump whose suction chamber is fitted with feeds for oil and gas. By loading the oil with gas, preferably with air, a reduction in the noise levels is attained when the vacuum pump is operating.

A vane-type rotary vacuum pump having the characteristics of the features of patent claim 1 is known from DE-A-3922417. The feed lines for gas and oil leading into the suction chamber of the oil pump according to the state-of-the-art are so arranged, that the oil pump will initially only pump air and then only oil. This is attained by designing the distance between the intake openings for air on the one hand and for oil on the other hand to be so great, that the intake opening for the oil is opened after the vane which follows next has already separated the circulating swept volume from the air intake opening. Simultaneous suction of air and oil is not possible. The known solution thus requires the use of an oil pump having at least three vanes which are arranged evenly spaced along its circumference. Only this ensures that oil will be sucked in also while the pump is running up. Without a supply of oil, both the oil pump and also the vane-type rotary vacuum pump which is to be supplied with oil would be damaged after a short time. A vane-type oil pump with three vanes is involved and thus costly. Moreover, the quantity of the air or quantity of the oil which is sucked in may only be influenced with the aid of nozzles with the risk that these might block.

From EU-A-474066 it is known to mix—in an oil pump which is also of the vane type—the supplied gas and oil before it enters into the oil pump. A Venturi nozzle is used for this. In the area of the Venturi nozzle the air flow and the oil flow run in parallel. Thus a pressure drop is created so that the oil is entrained with the gases. This solution too, is engineering wise relatively involved in particular because the use of a Venturi nozzle.

SUMMARY OF THE INVENTION

It is the task of the present invention to design an oil-sealed vacuum pump of the aforementioned kind in such a manner that its supply with a mixture of gas and oil is especially simple.

This task is solved through the present invention by the characteristic features of patent claim 1. In a vacuum pump designed according to the present invention, it is no longer required to employ oil pumps of the vane type and/or means which are independent of the oil pump to mix oil and air. Because initially oil and then a mixture of air and oil is sucked in simultaneously, gas and air are already mixed efficiently in the oil pump. Suction of oil at first and then oil as well as air is performed and it is released into the same swept volume. Oil pumps equipped with vanes in which the swept volumes need to separate the intake openings for air and gas at all times are no longer required. Furthermore, a special advantage is, that that quantity of the sucked in share of the air can be controlled by the angle of the intake opening for the air. The use of nozzles for the purpose of influencing the air/oil shares in the pumped mixture can be dispensed with.

BRIEF DESCRIPTION OF THE INVENTION

Figure 2:
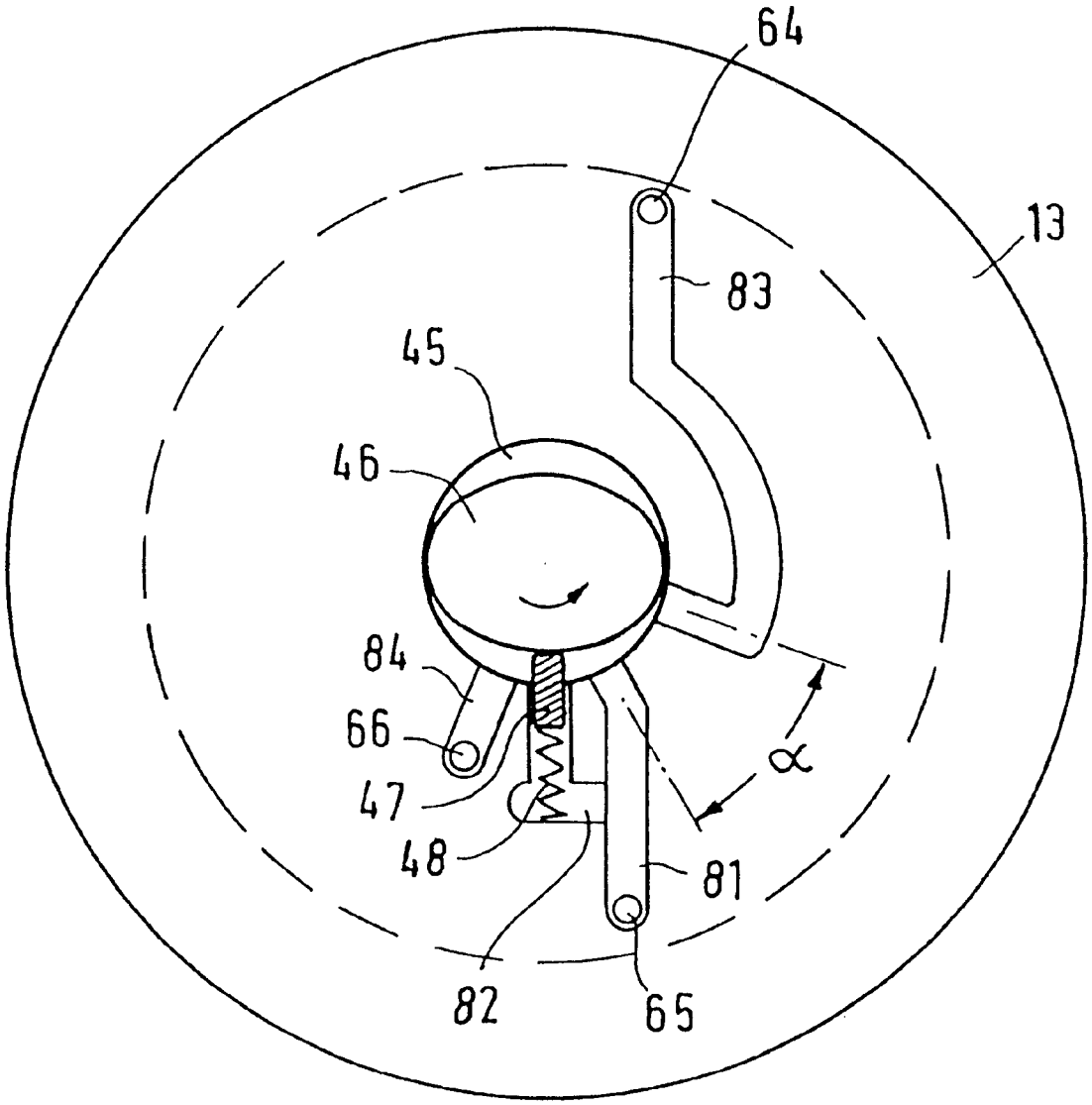

Further advantages and details of the present invention shall be explained on the basis of the design example presented in drawing FIGS. 1 and 2.

Drawing FIG. 1 a longitudinal section through a design example for a vane-type rotary vacuum pump according to the present invention and Drawing FIG. 2 a top view on to a bearing section in which the oil pump is accommodated.

The presented pump 1 comprises the subassemblies casing 2, rotor 3 and drive motor 4.

DESCRIPTION OF THE INVENTION

The casing 2 has substantially the shape of a pot with an outer wall 5, with the lid 6, with an inner section 7 and the suction chambers 8, 9 as well as rotor-mounting bore 11, with end section 12 and bearing section 13 which complete suction chambers 8, 9 at their face sides. The axis of the rotor-mounting bore 11 is designated as 14. Located between outer wall 5 and inner section 7 is the oil chamber 17, which during operation of the pump is partly filled with oil. Two oil level glasses 18, 19 (maximum, minimum oil level) are provided in the lid 6 for checking the oil level. An oil fill and oil drain are not shown. The oil sump is designated as 20.

Located within the inner section 7 is the rotor 3. It is designed as a single part and has two anchoring sections 21, 22 on the face side and a bearing section 23 located between anchoring sections 21, 22. The anchoring sections 21, 22 are equipped with slots 24, 25 for two vanes 26, 27. The presentation according to drawing FIG. 1 is so selected that the respective spaces between the vanes 28, 29 are placed in the plane of the drawing figure. The vane-mounting slots 25, 26 are each milled from the corresponding face side of the rotor so that precise slot dimensions can be attained in a simple manner. The bearing section 23 is located between anchoring sections 21, 22. Bearing section 23 and rotor-mounting bore 11 form the only bearing for the rotor.

Anchoring section 22 and the related suction chamber 9 have a greater diameter compared to anchoring section 21 with the suction chamber 8. Anchoring section 22 and suction chamber 9 form the high vacuum stage. During operation, the inlet of the high vacuum stage 9, 22 is linked to the intake port 30. The discharge of the high vacuum stage 9, 22 and the inlet of the forevacuum stage 8, 21 are linked via casing bore 31, which extends in parallel to the axes of the suction chambers 8, 9. The discharge of the forevacuum stage 8, 21 opens into the oil chamber 17. There the oil containing gases quite down and leave the pump 1 through the discharge port 33. For reasons of clarity the inlet and discharge openings of the two pumping stages are not shown in drawing FIG. 1. The casing 2 of the pump is preferentially assembled from as few parts as possible. At least the two suction chambers 8, 9 and the wall sections 5, 7 surrounding the oil chamber 17, should be made of a single piece.

Coaxial with axis 14 of the rotor-mounting bore 11, the bearing section 13 is equipped with a bore 35 for a rotor drive. This rotor drive may consist directly of the shaft 36 of the driving motor 4. In the design example presented in drawing FIG. 1, a coupling piece 37 is provided between the free face side of the driving shaft 36 and the rotor 3. The way in which the coupling piece 37 is coupled to the driving shaft 36 on the one hand and the rotor on the other hand is not described in detail. This is explained in DE-A-43 25 285 in greater detail.

The presented pump is equipped with an oil pump. This consists of the suction chamber 45 embedded in the bearing section 13 from the side of the motor and the oval eccentric 46 rotating in said suction chamber. In contact with the eccentric is a stopper 47 which is tensioned by spring 48. The eccentric 46 of the oil pump is part of the coupling piece 37. It is linked either firmly or by a positive fit—with axial play only—to the coupling piece 37.

In the presented design example with oil pump 45, 46, the bearing section 13 is equipped on its side which faces the motor 4 with a circular recess 58 in which a disc 59 is located. This disc is maintained in place by the casing 61 of the driving motor 4. Said disc is equipped with a central bore 62, which is penetrated by the shaft 36 of the driving motor 4. Moreover, it is the task of the disc 59 to limit the suction chamber 45 of the oil pump 45, 46.

Air from the oil chamber 17 is supplied via a first channel 64, and oil from the oil sump 20 is supplied via a second channel 65 to the oil pump 45, 46. The mixture of air and oil exiting the oil pump enters into channel 66 which opens into the rotormounting bore 11 (opening 67). At the level of opening 67, the bearing journal 23 is equipped with a radial through-hole 68 from which a longitudinal bore 69 with a nozzle 70 branches off in the direction of the space between the vanes 28. The position of the opening 67 of channel 66 on the one hand, and the opening of the radial bore 68 in the bearing journal 23 on the other hand, is so selected that oil from channel 66 can only briefly enter into bore 68 when the vanes 26 attain their T-position. If the radial bore 68 fully penetrates the bearing journal 23, there exist two openings, so that each time when the vanes attain their T-position a link is provided to oil pump 45, 46. During each turn of the rotor 3, the vanes 26 attain this T-position twice. In this position the space between the vanes 28 has its smallest volume. The mixture of oil and air which is injected by the nozzle briefly into the space between the vanes 28 flows through the space between the vanes 28 and enters into suction chamber 8 without being pressurised. For this, the inside of the lid 12 is equipped with a groove 71 which extends from the space between the vanes 28 into the suction chamber 8. In order to ensure that the space between the vanes 28 is permanently linked to the suction chamber 8, the free face side of anchoring section 21 is additionally equipped with a turned groove 72.

If the vacuum pump designed according to the present invention is a single-stage pump, then the significant share of the mixture of oil and air will flow via the bores 66, 68, 69 into the space between the vanes 28 and into the suction chamber 8, and from there it will return to the oil chamber 17. Only a very small share of the oil will enter into the bearing slot between rotor-mounting bore 11 as well as bearing journal 23 supplying this bearing with lubricating oil. It flows through the bearing slot and then also enters into the suction chamber 8. If the vacuum pump is - as presented in the design example according to drawing FIG. 1—of the two-stage type, then a third partial flow of mixed oil and air will enter into the bearing slot of bearing 11, 23 in the direction of the high vacuum stage 9, 22. Would the mixture of oil and air enter the high vacuum stage, then the air contained in the oil would impair the ultimate pressure characteristic of the vacuum pump. Therefore, a degassing step is performed along the passage from the opening 67 of channel 66 to suction chamber 9 of the high vacuum stage. For this, the bearing journal 23 is equipped with a circular groove 74 at the level at which a bore 75 opens which is linked with the intermediate vacuum (bore 31).

Shown in drawing FIG. 2 is a top view on to bearing section 13. The circular suction chamber 45 of the oil pump is embedded in the bearing section 13. Located in the suction chamber is rotor 46 of oval shape, against which the stopper 47 rests from below. The direction of rotation is marked by an arrow. Initially an oil feed 81 opens into the swept volume which increases in volume (to the right of stopper 47). This feed is formed by way of a groove in the surface of the bearing section 13 and extends from the opening of the oil supply channel 65 (drawing FIG. 1) to the suction chamber 45. It is linked via a branching groove 82 to the rear of the stopper 47 supplying the stopper with lubricating oil and providing a means of pressure relief within the slot of the vane.

An air feed 83 offset by the angle a opens into suction chamber 45. This feed too, is groove-shaped and is linked to the air feed channel 64 (drawing FIG. 1).

The sucked in mixture of oil and air is pumped by the corresponding swept volume to discharge 84. This is formed by a groove which is linked to the channel 66 (drawing FIG. 1).

The share of the air in the mixture of oil and air depends on the magnitude of the angle $\alpha$ (azimuth distance between air feed and oil feed). By changing this angle $\alpha$ it is possible to influence this share. The magnitude of the angle $\alpha$ is between 5° and 90°, preferably between 30 to 40. It is important that—and this applies also to rotors which differ in design from the one presented—during the a significant part of the suction phase both oil as well as air are sucked in.

What is claimed is:

1. An oil sealed vane type rotary pump that includes vacuum producing means for drawing air or gas from a container, said vacuum producing means being contained within a casing and further including a drive shaft for rotating said vacuum producing means, an oil pump enclosed within said casing, said oil pump further containing a suction chamber and a rotor mounted for rotation within said suction chamber for generating at least one sweep volume within said suction chamber as the rotor turns and a first feed means for delivering oil into said suction chamber and a second feed means for delivering a gas into said suction chamber, and said first and second feed means having entry ports to said suction chamber that are spaced apart so that oil is initially drawn into the sweep volume and thereafter both oil and gas are drawn into said sweep volume.

2. The rotary vacuum pump of claim 1 that further includes a stopper that is positioned downstream from and adjacent to an injection port through which oil and gas are delivered to the vacuum pump, said stopper extending across the suction chamber and riding in sealing contact with the oil pump rotor so that oil is initially delivered to the vacuum pump followed by a mixture of oil and gas as the sweep volume moves past said stopper.

3. The rotary pump of claim 2 wherein said rotor is elliptical in shape and generates two sweep volumes in said suction chamber.

4. The rotary vacuum pump of claim 1 wherein the rotor of the oil pump is secured for rotation to said drive shaft of the vacuum pump.

5. The rotary vacuum pump of claim 4 wherein said suction chamber is contained in a bearing section of the casing and further includes an end cover attached to the bearing section that forms a side wall of said suction chamber.

6. The rotary vacuum pump of claim 5 wherein an end face of said end cover closes against one wall of said bearing section, said end cover further includes grooves in said end face and said one wall which opens into said suction chamber for conducting oil and gas into and out of said suction chamber.

7. The rotary vacuum pump of claim 1 wherein said casing further includes a channel in which said stopper means is slidably contained, said channel being coupled to said first oil feed means.

8. The rotary vacuum pump of claim 1 having further means for delivering an oil and gas mixture from the suction chamber to a vacuum chamber of the rotary pump.

* * * * *